US011439888B2

(12) United States Patent
Altshuler

(10) Patent No.: US 11,439,888 B2
(45) Date of Patent: Sep. 13, 2022

(54) ADJUSTABLE ICE SKATE BLADE TO BOOT CONNECTOR

(71) Applicant: Edward Lafe Altshuler, Erie, CO (US)

(72) Inventor: Edward Lafe Altshuler, Erie, CO (US)

( * ) Notice: Subject to any disclaimer, the term of this patent is extended or adjusted under 35 U.S.C. 154(b) by 0 days.

(21) Appl. No.: 17/151,054

(22) Filed: Jan. 15, 2021

(65) Prior Publication Data

US 2021/0213347 A1 Jul. 15, 2021

Related U.S. Application Data

(60) Provisional application No. 62/961,311, filed on Jan. 15, 2020.

(51) Int. Cl.
*A63C 1/02* (2006.01)
*A63C 1/32* (2006.01)

(52) U.S. Cl.
CPC . *A63C 1/02* (2013.01); *A63C 1/32* (2013.01)

(58) Field of Classification Search
CPC ..... A63C 1/02; A63C 1/32
See application file for complete search history.

(56) References Cited

U.S. PATENT DOCUMENTS 3,243,191 A * 3/1966 Weisman ..... A63C 1/02 280/11.12
3,339,935 A * 9/1967 Weisman ..... A63C 1/02 280/11.12
4,132,424 A * 1/1979 Olivieri ..... A63C 1/02 280/11.3
4,351,536 A * 9/1982 Sandino ..... A63C 1/00 280/11.12
5,503,412 A * 4/1996 Hill ..... A63C 1/22 280/11.27
2011/0316243 A1* 12/2011 Glass ..... A63C 17/067 280/11.3
2013/0175771 A1* 7/2013 Shepley ..... A63C 1/16 280/11.3
2013/0285338 A1* 10/2013 Blois ..... A63C 1/42 280/11.14
2018/0185735 A1 7/2018 Labonte
2021/0086057 A1* 3/2021 Altshuler ..... A63C 1/303

* cited by examiner

*Primary Examiner* — Brian L Swenson
(74) *Attorney, Agent, or Firm* — Kenneth Altshuler

(57) ABSTRACT

Disclosed herein are embodiments describing a front and rear ice-skate adapter that are configured to join a respective front and rear ice-skate blade post to the sole of an ice-skating boot. In certain instances each ice-skate blade post is a multi-degree of freedom adjustable cup that adjusts the position of an ice-skating blade relative to the ice-skate boot sole. Each ice-skate adapter generally comprises a skate sole end that attaches to an ice-skate boot sole and a skate end that attaches to a respective ice-skate blade post. A cup body is defined between the skate sole end and the skate end. The skate sole end comprises a surface that conforms to the shape of the ice-skating boot sole. For added stiffness and stability, the skate sole end further comprises a plurality of appendages that extend outwardly from the cup body.

18 Claims, 10 Drawing Sheets

ADJUSTABLE ICE SKATE BLADE TO BOOT CONNECTOR

CROSS-REFERENCE TO RELATED APPLICATIONS

This application claims priority to and the benefit of U.S. provisional Patent Application No. 62/961,311, entitled: ICE SKATE ADAPTER PLATE, filed on Jan. 15 2018, the entire disclosure of which is hereby incorporated by reference.

FIELD OF THE INVENTION

The present embodiments are directed to connector that connects and ice skate to an the sole of an ice skate boot.

SUMMARY OF THE INVENTION

The present embodiments are directed to connector embodiments that connects and ice skate to an the sole of an ice skate boot.

Certain embodiments of the present invention contemplate an ice skate adapter comprising a cup body defined between a skate sole end and a skate end, said skate sole end extending toward said skate end in a vertical direction. The ice skate adapter also comprises a sole interface surface defined at said skate sole end and including at least a portion of said skate sole end, said sole interface surface conforming to a skate sole. At least two of the appendages extend outwardly from said cup body in a horizontal direction. The at least two appendages form part of said sole interface surface. The at least two appendages are resistant to vertical bending forces in said vertical direction. Each appendage comprises an adapter-to-sole attachment member that is located towards an appendage distal end, The skate sole end is configured to attach to said skate boot sole via said adapter-to-sole attachment members and said skate end configured to attach to a skate blade, albeit by way of a cup.

Other certain embodiments of the present invention contemplate an adjustable ice-skate blade-to-boot connector comprising a cup body defined between sole interface surface and a cup surface wherein the sole interface surface conforms to a portion of a skate boot sole. A plurality of appendages are envisioned extending outwardly from said cup body wherein said plurality of appendages are part of said cup surface. A bolt receiving aperture is located at a distal end of each of said appendages. A bolt receiving aperture extends through said cup surface whereby said bolt receiving aperture is configured to connect said connector with an ice-skate blade post.

Yet other certain embodiments of the present invention contemplate an ice skate joiner comprising a cup body defined between a first end and a second end and a plurality of appendages extending outwardly from said cup body. The plurality of appendages collectively define a boot sole surface that conforms to a portion of a skate boot sole. The boot sole surface is at said first end. A bolt receiving aperture (bolt hole) is located at a distal end of each of said appendages. At least two of said appendages comprise a ring (which is equal to a partial ring) surrounding said bolt receiving aperture. The ring is larger than an appendage width of said corresponding appendage. In the case of the front ice skate joiner the appendages extending towards the leading edge and the trailing edge comprise rings that are larger than the appendage widths, however the middle appendages that extend from the sides do not have a ringed end that is larger, and may not have a ringed distal end, whatsoever. said second end defining a ice-skate blade post interface surface that is matingly engaged with an ice-skate blade post via a locking bolt.

DETAILED DESCRIPTION

Initially, this disclosure is by way of example only, not by limitation. Thus, although the instrumentalities described herein are for the convenience of explanation, shown and described with respect to exemplary embodiments, it will be appreciated that the principles herein may be applied equally in other types of situations involving similar uses of attaching a skate to a skate boot sole. The phrases "in one embodiment", "according to one embodiment", and the like generally mean the particular feature, structure, or characteristic following the phrase is included in at least one embodiment of the present invention, and may be included in more than one embodiment of the present invention. Importantly, such phases do not necessarily refer to the same embodiment. If the specification states a component or feature "may", "can", "could", or "might" be included or have a characteristic, that particular component or feature is not required to be included or have the characteristic. In what follows, similar or identical structures may be identified using identical callouts.

Disclosed herein are embodiments describing an adjustable ice-skate blade to boot connector, also referred to herein as an ice-skate adapter. Some examples include a front and rear ice-skate adapter that are configured to join a respective front and rear ice-skate blade post to the sole of an ice-skating boot. In certain instances each ice-skate blade post is a multi-degree of freedom adjustable cup that adjusts the position of an ice-skating blade relative to the ice-skate boot sole. Each ice-skate adapter generally comprises a skate sole end that attaches to an ice-skate boot sole and a skate end that attaches to a respective ice-skate blade post. A cup body is defined between the skate sole end and the skate end. The skate sole end comprises a surface that conforms to the shape of the ice-skating boot sole. For added stiffness and stability, the skate sole end further comprises a plurality of appendages that extend outwardly from the cup body.

Figure 1:
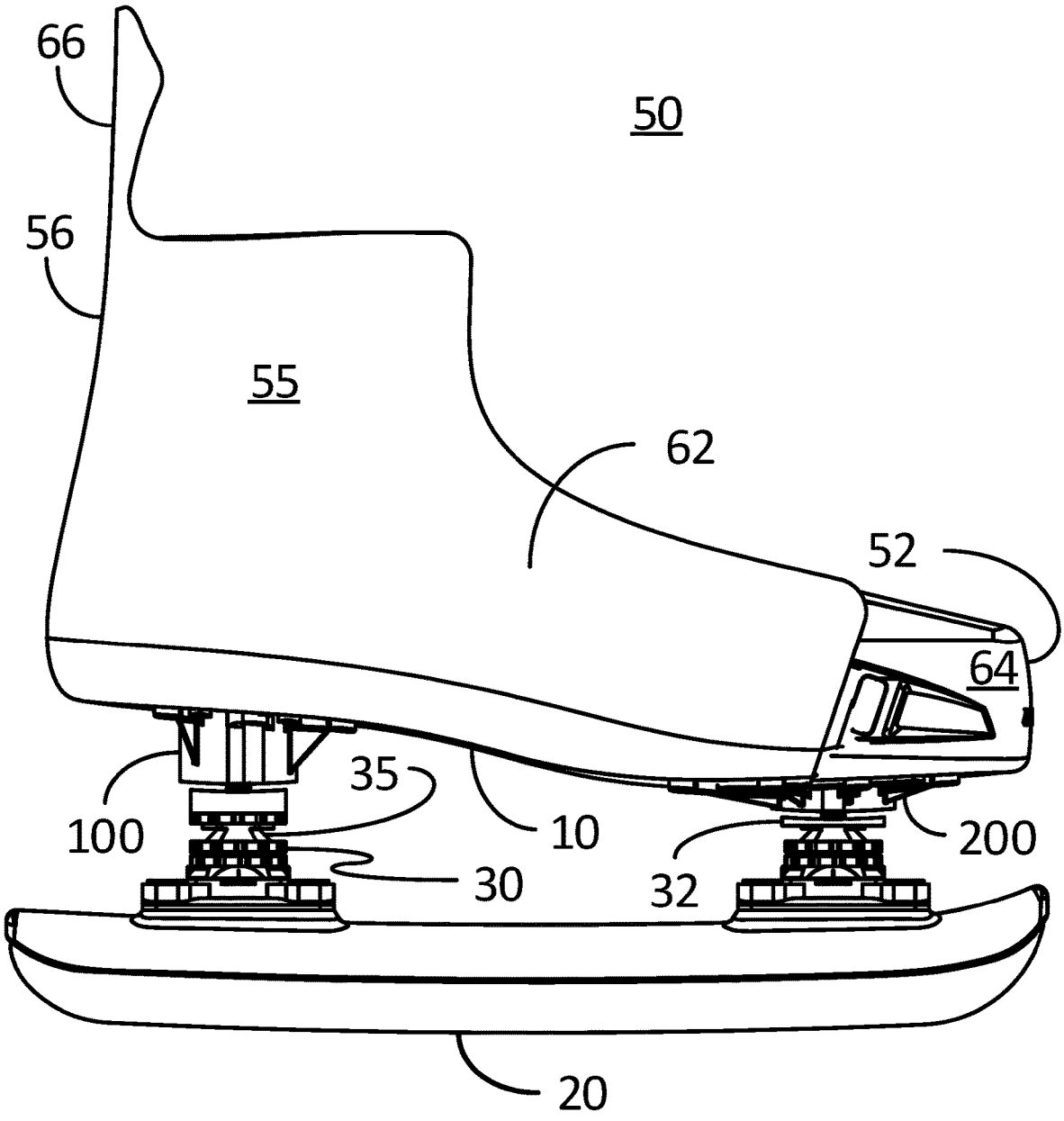
FIG. 1 is a line drawing of an ice skate boot assembly consistent with embodiments of the present invention.

FIG. 1 is a line drawing of an ice skate boot assembly consistent with embodiments of the present invention. The ice skate boot assembly 50 is an example of a suitable environment in which embodiments of the present invention can be advantageously practiced. As shown, this is a side view of an ice-skating boot 55 connected to an ice-skating blade 20. More specifically, the ice-skating blade 20 is connected to the ice skate boot sole 10 (or simply boot sole) by way of an adjustable rear ice-skate blade post 30 and rear ice-skate and front ice-skate adapter 200. The adjustable rear ice-skate blade post 30 is also referred to herein as a "rear cup" 30 and rear ice-skate adapter 100 is also referred to herein as a "front cup" 32. A standard ice-skating boot 55 generally comprises a hard shell body 62 with toe protection 64 at the ice-skating boot front end 52. A tendon guard 66 is often built into the ice-skating boot rear end 56 to protect the wearer's achilles tendon. In the present configuration, the front cup 32 and the rear cup 30 are multi-degree of freedom adjustable cups that are lockable (able to be locked) into a specific configuration via locking rings 35. In this way, the ice-skating blade 20 can be set in a particular orientation with respect to the boot sole 10. Certain embodiments described herein are directed to the rear ice-skate adapter 100 and front ice-skate adapter 200.

Figure 2A:
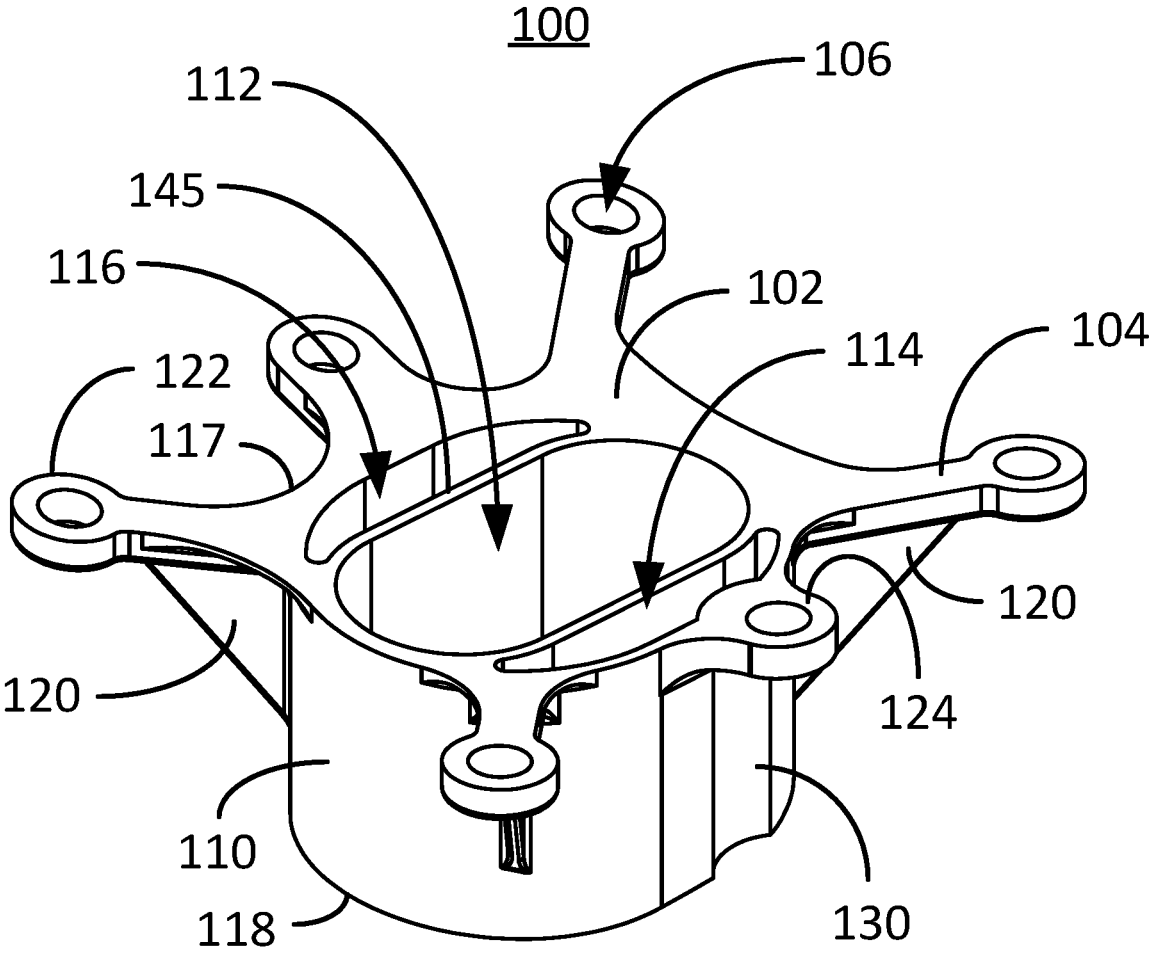
FIGS. 2A-2E are various line drawings views of a rear ice-skate adapter embodiment 100 for a right-footed ice-skating boot consistent with embodiments of the present invention.

FIGS. 2A-2E are various line drawings views of a rear ice-skate adapter embodiment 100 for a right-footed ice-skating boot consistent with embodiments of the present invention. FIG. 2A is an isometric view of the rear ice-skate adapter 100 (also referred to as an adjustable ice-skate blade to boot connector) presenting the sole interface surface 102. The rear ice-skate adapter 100 comprises a cup body 110 defined between a skate sole end 117 and a skate blade end 118. In the present embodiment, the skate sole end 117 comprises a smooth sole interface surface 102 that is slightly concave to conform to the mating/bottom surface of the boot sole 10. Certain embodiments envision the cup body diameter 158 (of FIG. 2D) being between 1 inch and 2.5 inches. In other words, the sole interface surface 102 contacts or otherwise presses up against a mating region of the boot sole 10. There are six appendages 104 extending outwardly from the cup body 110, as shown. Other embodiments contemplate more or less appendages 104 than the number shown here. Each of the appendages 104 are part of the sole interface surface 102. Each of the appendages 104 comprises an adapter-to-sole attachment member 122 that in this embodiment is an appendage bolt hole 106, but can just as easily be a semicircular opening/hole, a peg, a combination, or some other configuration known to those skilled in the art. Each of the appendages 104 is defined by an appendage thickness 155 (of FIG. 2C), to provide added stiffness to the rear ice-skate adapter 100 when mounted on the bottom of a boot sole 10. Each of the appendages 104 can further comprise an appendage-to-cup web 120 to increase stiffness by way of an increased secondary moment of inertia. For weight considerations, the cup body 110 is a hollow member that comprises a hollow center core 112 and two hollow side cores 114 and 116 separated by a core stiffening web 145. The hollow center core 112 and the two hollow side cores 114 and 116 reduce weight of the rear ice-skate adapter 100. In the present embodiment, there is an access channel 130 in the side of the cup body 110 associated with the inner boot side appendage 124. The access channel 130 provides easy access to screw a bolt (not shown) into the boot sole 10 when affixing the rear ice-skate adapter 100 to the boot sole 10. The rear ice-skate adapter 100 can be a unitary element, which can be molded from a composite, such as a carbon fiber composite, or machined from a metal, such as aluminum or titanium. Optional embodiments contemplate 3-D printing the rear ice-skate adapter 100.

Figure 2B:
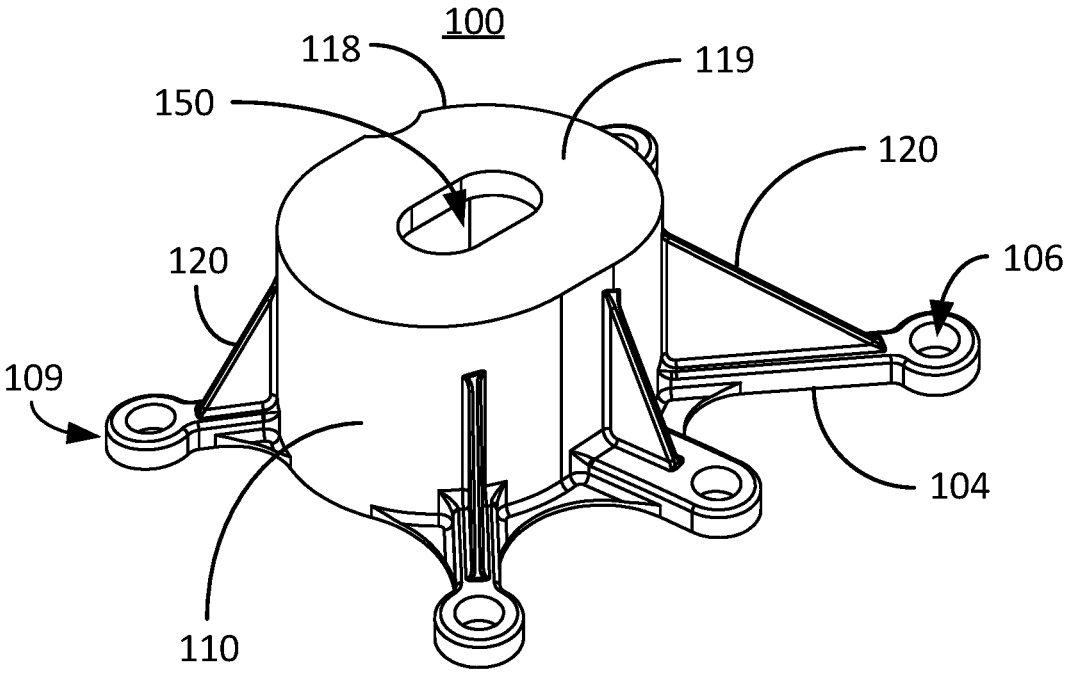

FIG. 2B is an isometric line drawing of the rear ice-skate adapter 100 presenting a view of the skate end 118. From this perspective, the rear ice-skate adapter 100 shows the triangular shaped webs 120 extending between near the distal (or free) ends 109 of the appendages 104 and the cup body 110. The bolt holes 106 are arranged to align with receiving threaded/tapped holes the boot sole 10, which in certain configurations are threaded sleeves for strength when torqueing the attaching bolts (not shown) through the bolt holes 106 to attach the rear ice-skate adapter 100 to the boot sole 10. The rear ice-skate adapter 100 can be hand bolted to the bottom of the skate sole 10. In this embodiment, a rear cup surface 119, which is at the skate end 118, is arranged to contact or otherwise mate with the rear cup 30, as shown in FIG. 1. The rear cup surface 119 does not have a parallel relationship with the skate sole end 117 to accommodate the ark of the boot sole 10. If the boot sole 10 is not marked, then certain embodiments envision the rear cup surface 119 having a parallel relationship with the skate sole end 117. A bolt receiving aperture 150 penetrates through the rear cup surface 119. The bolt receiving aperture 150 is sized to receive a locking bolt (not shown) to fixedly connect the rear ice-skate adapter 100 to the rear cup 30. In the present embodiment, the bolt receiving aperture 150 is oblong to accommodate tolerances and in some cases the adjustability of the rear cup 30. Also, here the rear cup surface 119 is essentially flat, though other embodiments envision a concave or convex surface.

Figure 2C:
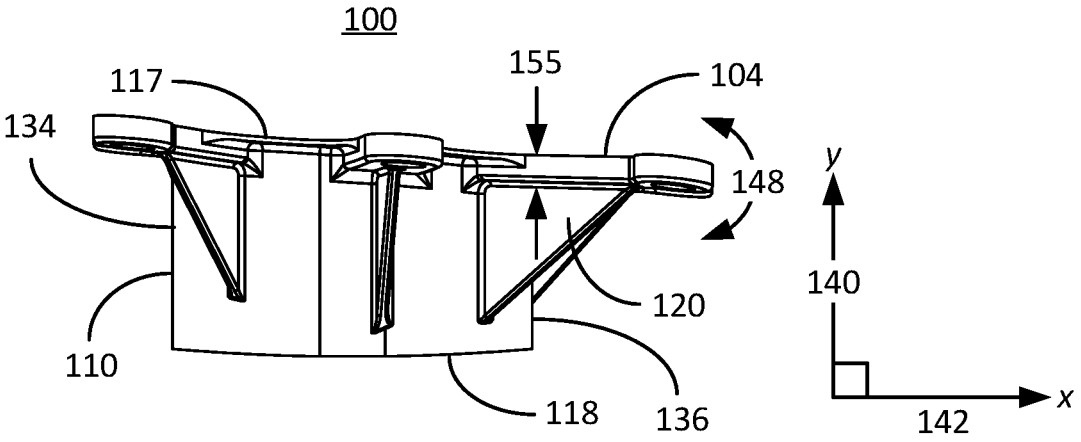

FIG. 2C is a side view line drawing of the rear ice-skate adapter 100 with the skate sole end 117 above the skate end 118, oriented as if it were attached to a skate boot sole 10 and skate blade 20 with the skate blade 20 in contact with a sheet of ice (not shown). The cup body 110 extends essentially in the vertical (y) direction 140 from the skate end 118 to the skate sole end 117 with a length in a range between 0.5 inches and 2.0 inches. In this embodiment, the skate sole end 117 is not parallel with the skate end 118, rather the skate sole end 117 is further away from the skate end 118 at the trailing (heel) end/edge 134 as compared with the leading (toe) end/edge 136. The trailing (heel) end/edge 134 is the part of the rear ice-skate adapter 100 that is closest to the ice-skating boot rear end 56 and the leading (toe) end/edge 136 is closest to the ice-skating boot front end 52. The appendage thickness 155, which helps resists bending 148, shown in the direction of the double arrowed arc (which is primarily bending in the y-direction 140 with a small component in the x-direction 142). The webs 120 further resist bending 148 due to the relatively high secondary moment of inertia.

Figure 2D:
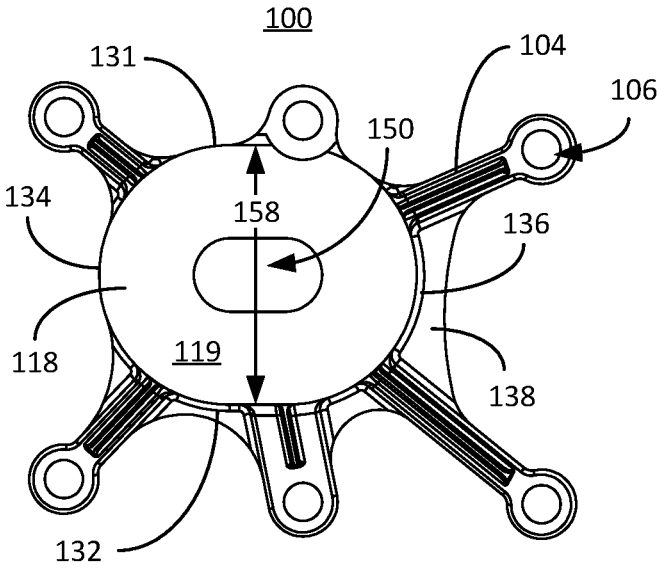

FIG. 2D is a bottom view line drawing of the rear ice-skate adapter 100 with the rear cup surface 119 facing out of the page. The rear ice-skate adapter 100 is oriented with the trailing edge 134 to the left and the leading edge 136 to the right. Also, the rear ice-skate adapter 100 defines an inner-foot side 131 that is closest to the ice-skating boot inner edge 305 (of FIG. 4A) of the ice-skating boot 55 and an outer-foot side 132 that is closest to the ice-skating boot outer edge 310 (of FIG. 4A). In this embodiment, there are horizontal appendage-to-appendage webs 138 that resist bending an appendage 104 primarily in the horizontal (x) direction 142. The appendage-to-appendage webs 138 offer some additional stability to the appendages 104 when the rear ice-skate adapter 100 is anchored to the boot sole 10 via bolts (not shown). The term 'primarily' in the x-direction 142 means that there is a small deflection component in the z-direction and potentially in the y-direction. Likewise, the term 'primarily' in the y-direction means that there is a small component of deflection in the x-direction, for example. As previously mentioned, the rear cup surface 119 mates with and is attached to the rear cup 30 via a locking bolt (not shown) extending through the bolt receiving aperture 150.

Figure 2E:
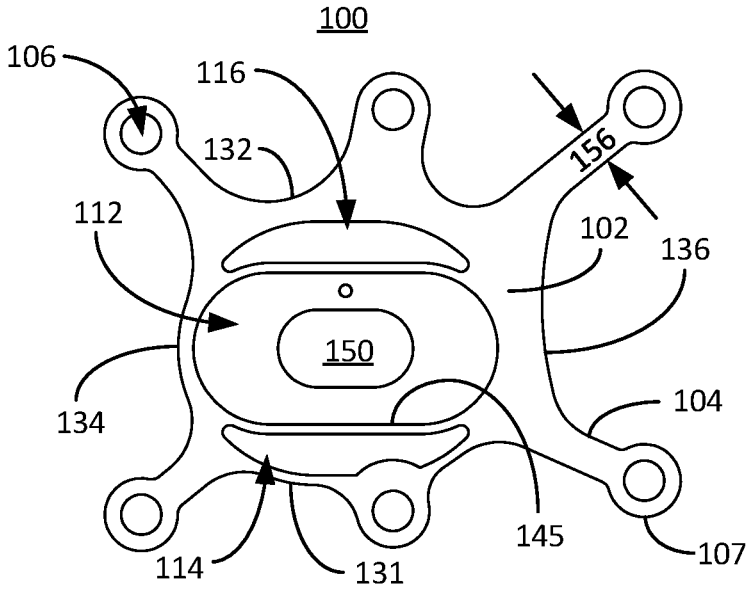

FIG. 2E is a top view line drawing of the rear ice-skate adapter 100 with the hollow center core 112 facing out of the page. The rear ice-skate adapter 100 is oriented with the trailing edge 134 to the left and the leading edge 136 to the right. The rear ice-skate adapter 100 shows the inner-foot side 131 and the outer-foot side 132. The horizontal appendage-to-appendage webs 138 form part of the sole interface surface 102. As previously mentioned, the sole interface surface 102 mates with and is attached to the boot sole 10 via bolts (not shown) extending through each of the appendage boot holes 106. Also, it should be readily apparent that a left-footed rear ice-skate adapter is the mirror image of a right-footed rear ice-skate adapter as shown in FIGS. 2A-2E.

Figure 3A:
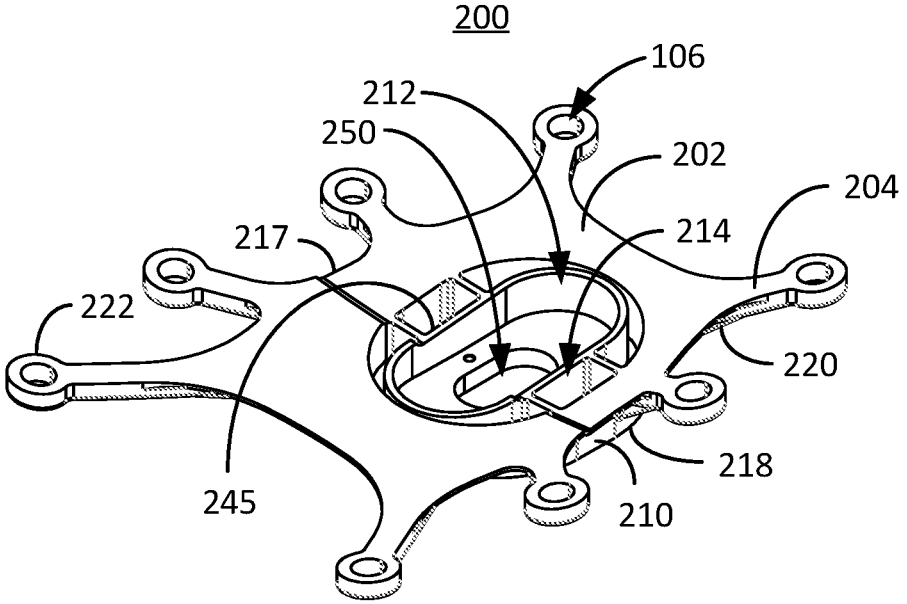
FIGS. 3A-3E are various line drawings views of a front ice-skate adapter embodiment for a right-footed ice-skating boot consistent with embodiments of the present invention.

FIGS. 3A-3E are various line drawings views of a front ice-skate adapter embodiment 200 for a right-footed ice-skating boot consistent with embodiments of the present invention. FIG. 3A is an isometric view of the front ice-skate adapter 200 presenting the sole interface surface 202. The front ice-skate adapter 200 comprises a cup body 210 defined between a skate sole end 217 in the skate blade end 218. In the present embodiment, the skate sole end 217 comprises a smooth sole interface surface 202 that is slightly concave to conform to the mating/bottom surface of the boot sole 10. More precisely, the sole interface surface 202 contacts or otherwise presses up against the mating region of the boot sole 10. There are eight appendages 204 extending outwardly from the cup body 210, as shown. Other embodiments contemplate more or less appendages 204 than the number shown here. Each of the appendages 204 a part of the sole interface surface 202. Each of the appendages 204 comprises an adapter-to-sole attachment member 222 that in this embodiment is an appendage bolt hole 106. Each of the appendages 204 is defined by an appendage thickness 155 (of FIG. 3C), to provide added stiffness to the ice-skate adapter 200 when mounted on the bottom of a boot sole 10. Certain embodiments contemplate the appendage thickness 155 being between 0.2 inches and 0.5 inches thick with a width 156 between 0.2 inches and 0.75 inches wide. Each appendage 204 can further comprise an appendage-to-cup web 220 two increase stiffness by way of an increased secondary moment of inertia. For weight considerations, the cup body 210 is a hollow member that comprises a hollow center core 212 surrounded by peripheral cores 214 that are defined by a core stiffening web 245. The hollow center core 212 and the surrounding peripheral cores 214 reduce weight of the ice-skate adapter 200. The front ice-skate adapter 200 can be a unitary element, which can be molded from a composite, such as a carbon fiber composite, or machine from metal, such as aluminum or titanium. Optional embodiments contemplate 3-D printing the front ice-skate adapter 200.

Figure 3B:
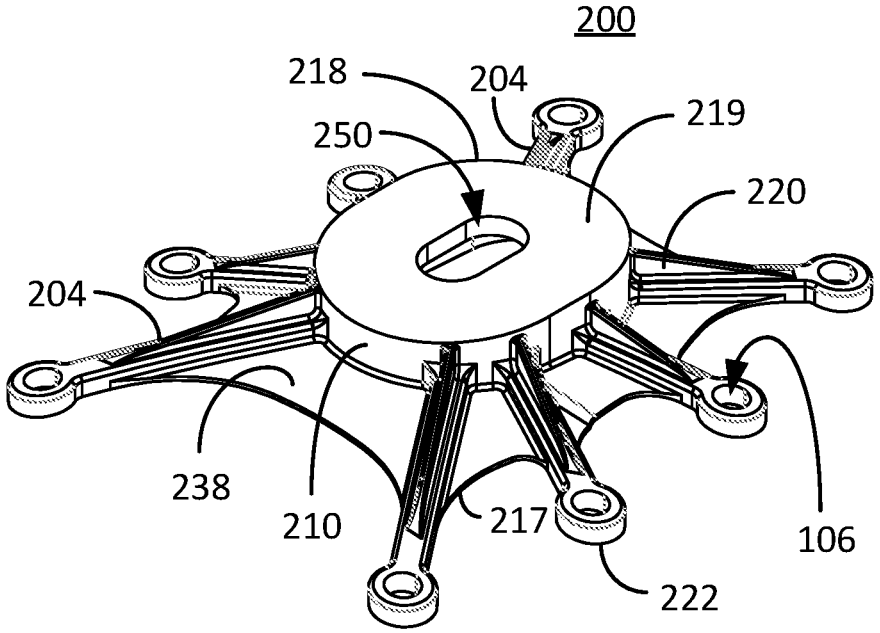

FIG. 3B is an isometric line drawing of the front ice-skate adapter 200 presenting a view of the skate and 218. From this perspective, the front ice-skate adapter 200 shows a triangular-shaped appendage-to-cup webs 220 extending between the cup body 210 and towards (near) the distal ends 109 of the appendages 204. In this configuration, the appendage-to-cup webs 220 extending near the distal ends 109 of the appendages 204 but not so far as to obstruct any of the bolt holes 106. Moreover, the appendage-to-cup webs 220 do not extend far enough to obstruct a region near the bolt holes 106 that accommodate a bolt head to lock onto the surface surrounding the corresponding bolt hole 106. The bolt holes 106 are arranged to align with receiving threaded, or tapped, holes in the boot sole 10, which in certain configurations are threaded sleeves for strength to compensate for torqueing down the attaching bolts (not shown) when attaching the front ice-skate adapter 200 to the boot sole 10. The ice-skate adapter 200 can be hand bolted to the bottom of the skate sole 10. In this embodiment, the front cup surface 219, which is at the skate and 218, is arranged to contact with the front cup 32, as shown in FIG. 1. The front cup surface 219 does not have a parallel relationship with the skate sole end 217 to accommodate the ark of the boot sole 10. If the boot sole 10 is not art or otherwise flat across the length of the boot sole 10, then certain embodiments envision the front cup surface 219 having a parallel relationship with the skate sole end 217. A bolt receiving aperture 250 penetrates through the front cup surface 219. The bolt receiving aperture 250 is sized to receive a locking bolt (not shown) to fixedly connect the front ice-skate adapter 200 to the front cup 32. In the present embodiment, the bolt receiving aperture 250 is oblong to accommodate tolerances and in some cases the adjustability of the front cup 32. Also, here is the front cup surface 219 is essentially flat, though other embodiments envision a concave or convex surface.

Figure 3C:
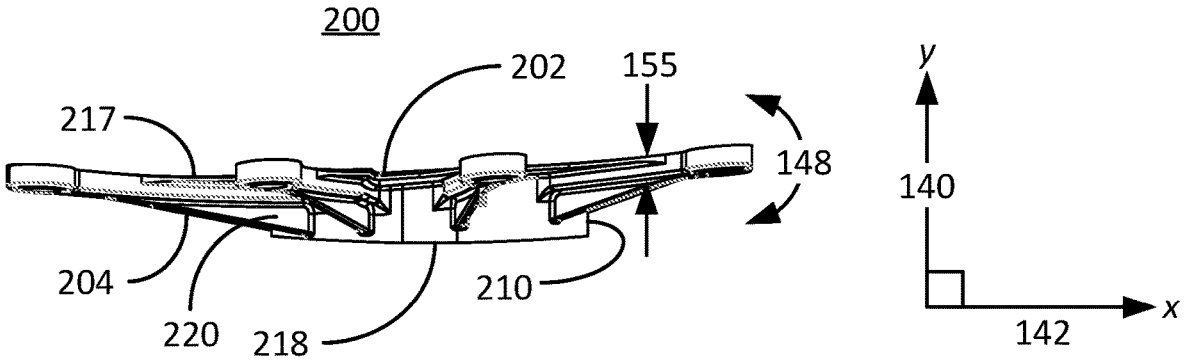

FIG. 3C is a side view line drawing of the front ice-skate adapter 200 with the skate sole end 117 located above the skate end 118, oriented as if it were attached to a skate boot sole 10 and the skate blade 20 with the skate blade 20 in contact with a sheet of ice (not shown). The cup body 210 extends essentially in the vertical (y) direction 140 from the skate end 118 to the skate sole end 117 with a length in a range between 0.25 inches and 1.5 inches. In this embodiment, the skate sole end 217 is not parallel with the skate end 218, rather the skate sole end 217 is further away from the skate end 118 at the trailing (heel) edge 234 as compared with the leading (toe) edge 236. The trailing edge 234 is the part of the front ice-skate adapter 200 that is closest to the ice-skating boot rear end 56 and the leading edge 236 is closest to the ice-skating boot front end 52. The appendage thickness 155, which helps resist bending 148, shown in the direction of the double arrow arc 148. The appendage-to-cup webs 220 further resist bending 148 due to the relatively high secondary moment of inertia. Certain embodiments contemplate the appendage thickness 155 being between 0.2 inches and 0.5 inches thick with a width 156 between 0.2 inches and 0.75 inches wide.

Figure 3D:
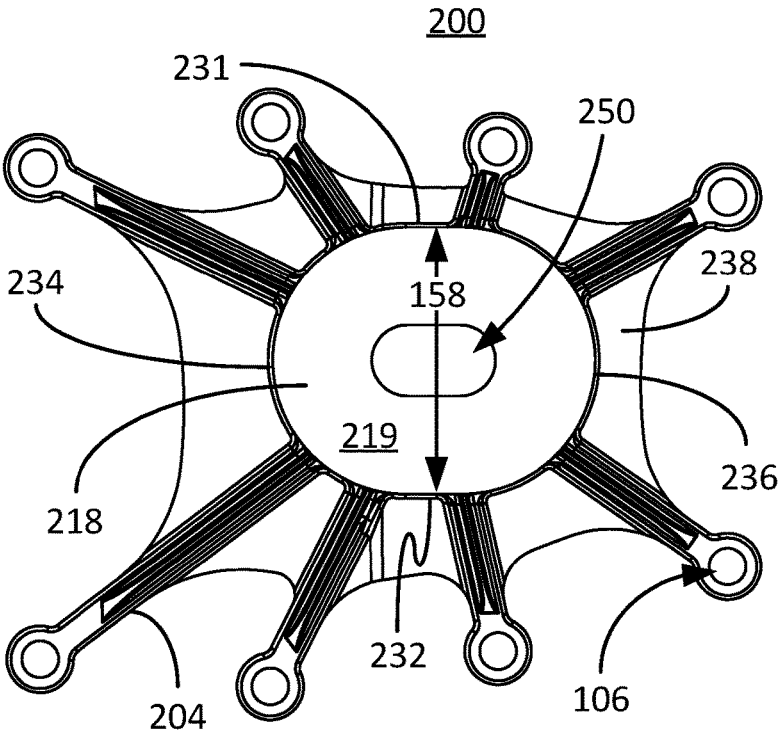

FIG. 3D is a bottom view line drawing of the front ice-skate adapter 200 with the front cup surface 119 facing out of the page. The front ice-skate adapter 200 is oriented with the trailing edge 234 to the left and the leading edge 236 to the right. Also, the front ice-skate adapter 200 defines an inner-foot side 231 that is closest to the ice-skating boot inner edge 305 (of FIG. 4A) of the ice-skating boot 55 and an outer-foot side 232 that is closest to the ice-skating boot outer edge 310 (of FIG. 4A). In this embodiment, there are horizontal-to-horizontal appendage webs 238 that resist bending and appendage 204 primarily in the horizontal (x) direction 142. The appendage-to-appendage webs 238 offer some additional stability to the appendages 204 when the front ice-skate adapter 200 is anchored to the boot sole 10 via bolts (not shown). As previously mentioned, the front cup surface 219 mates and is attached to the front cup 32 via a locking bolt (not shown) extending through the bolt receiving aperture 250.

Figure 3E:
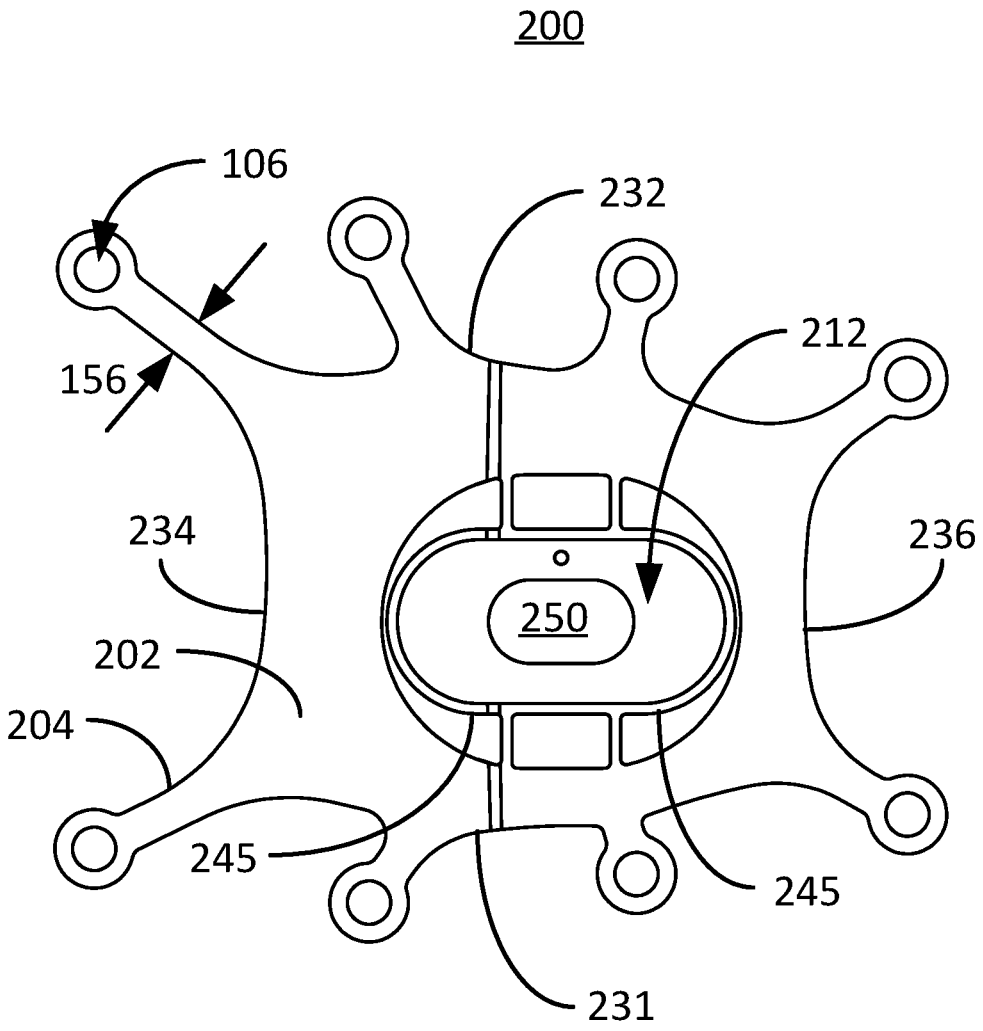

FIG. 3E is a top view line drawing of a front ice-skate adapter 200 with the hollow center core 212 facing out of the page. The front ice-skate adapter 200 is oriented with the trailing edge 234 to the left and the leading edge 236 to the right. The front ice-skate adapter 200 shows the inner-foot side 231 and the outer-foot side 232. The horizontal appendage-to-appendage webs to earn 38 form part of the sole interface surface 202. As previously mentioned, the sole interface surface 202 mates with and is attached to the boot sole 10 via bolts (not shown) extending through each of the appendage boot holes 106. Also, it should be readily apparent that a left-footed front ice-skate adapter 200 is the mirror image of a right-footed front ice-skate adapter as shown in FIGS. 2A-2E.

Figure 4A:
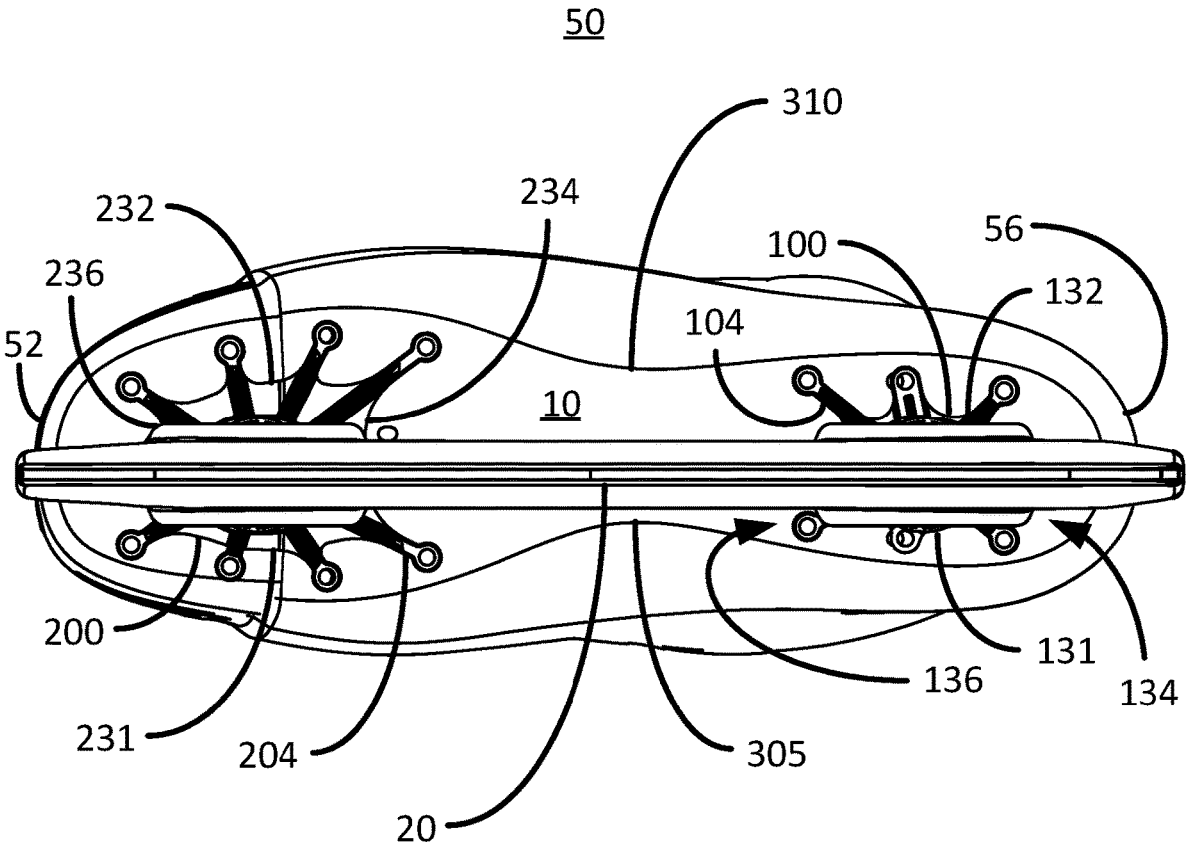
FIGS. 4A-4C are line drawings of various views of an ice skate boot assembly with ice-skate adapter embodiments consistent with embodiments of the present invention.
Figure 4B:
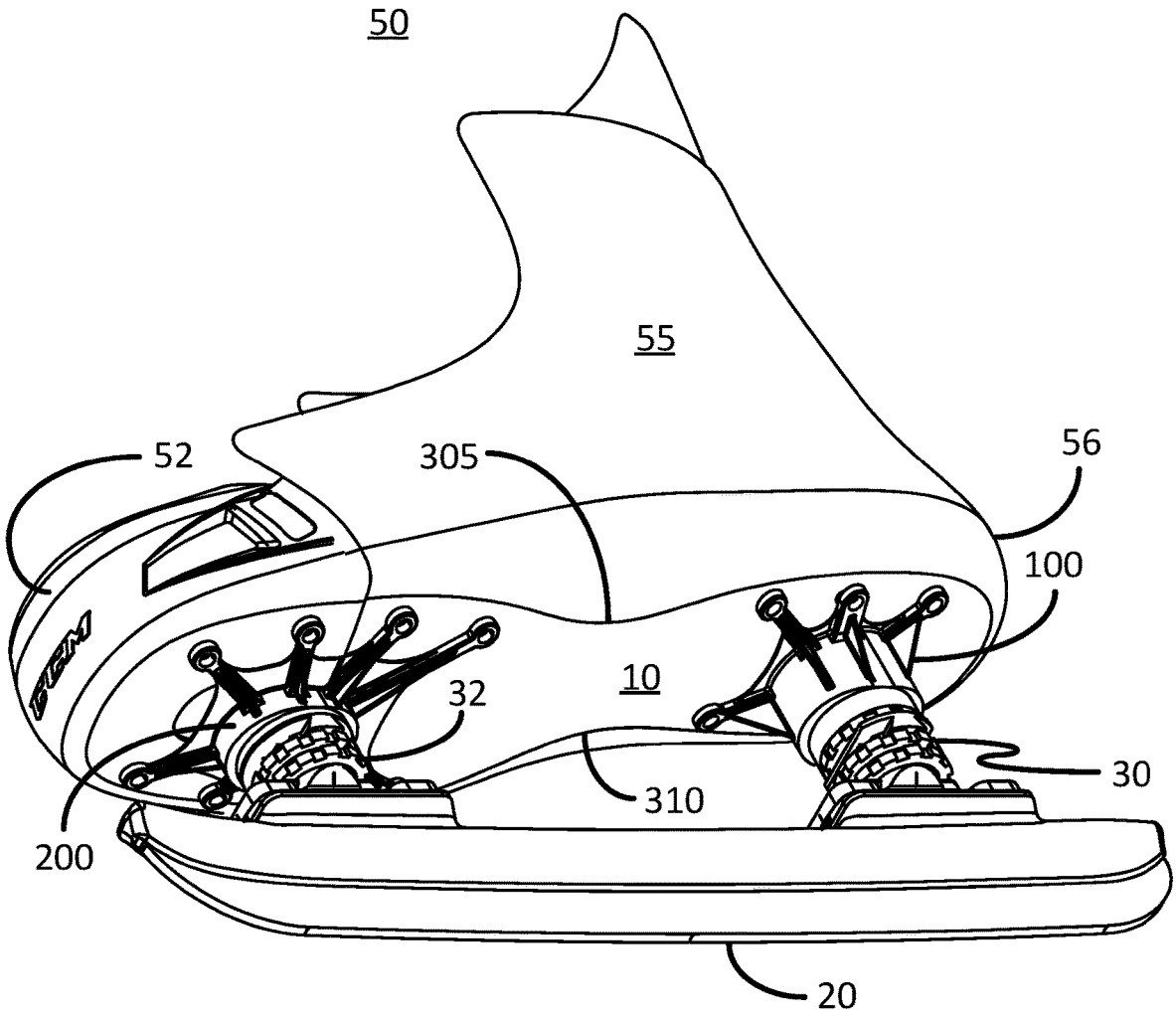
Figure 4C:
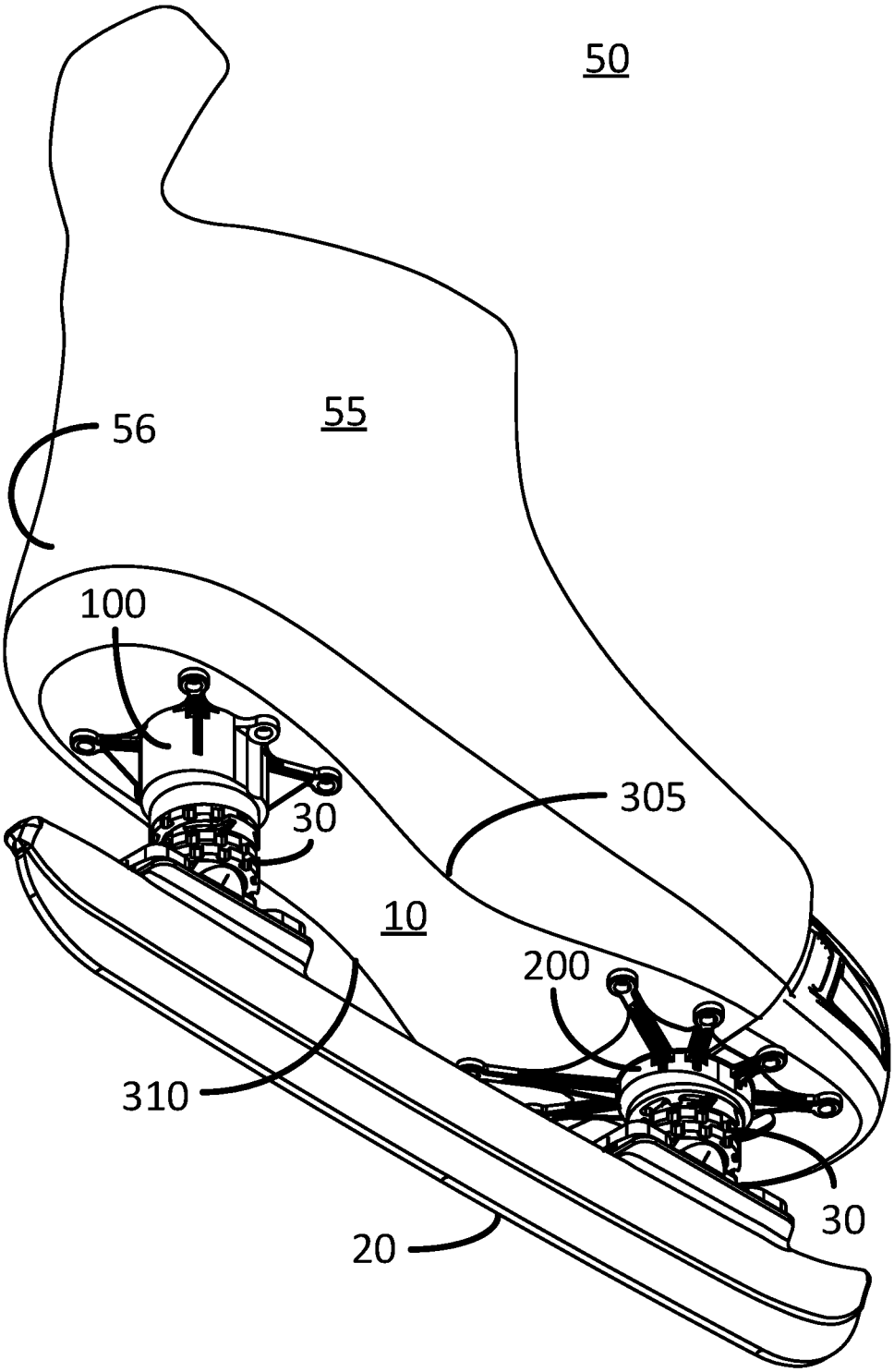

FIGS. 4A-4C are line drawings of various views of an ice skate boot assembly 50 with ice-skate adapter embodiments consistent with embodiments of the present invention. FIG. 4A depicts a bottom view of a left footed ice skate boot assembly 50 with the ice skate blade 20 coming out of the page and the entire boot sole 10 essentially in plane with the page. As shown, the front ice-skate adapter 200 is fixedly attached to the boot sole 10 by way of eight bolts engaged with corresponding threaded bolt holes via the appendage bolt holes 106 in the front ice-skate adapter 200. Likewise, the rear ice-skate adapter 100 is fixedly attached to the boot sole 10 by way of six bolts engaged with corresponding threaded bolt holes via the appendage bolt holes 106 in the rear ice-skate adapter 100. The appendages 104 and 204 are splayed (or spread out) across the rear and front side of the boot sole 10 taking advantage of utilizing the boot sole surface area for added stability. The boot sole 10 defines an ice-skating boot inner edge 305 and an ice-skating boot outer edge 310. Accordingly, the front ice-skate adapter 200 defines an inner-foot side 231 that is closest to the ice-skating boot inner edge 305 and an outer-foot side 232 that is closest to the ice-skating boot outer edge 310. The front ice-skate adapter 200 also shows the leading edge 236 relative to the ice-skating boot front end 52 and the trailing edge 234 in the direction extending towards the ice-skating boot rear end 56. Likewise, the rear ice-skate adapter 100 shows where the inner-foot side 131 is relative to the boot inner edge 305 and the outer-foot side 132 is relative to the boot outer edge 310. The rear ice-skate adapter trailing edge 134 extends towards the ice-skate boot heel 56 and the rear ice-skate adapter leading edge 136 extends towards the ice-skate boot toe 52.

FIG. 4B depicts a perspective drawing a right footed ice-skate boot assembly 50 tipped at an angle towards the viewer. As shown from this perspective, the front adjustable cup 32 is connected or linked to the front ice-skate adapter 200 on one end and the ice-skate blade 20 on the other and the rear adjustable cup 30 is connected to the rear ice-skate adapter 100 on one end and the ice-skate blade 20 on the other. The front ice-skate adapter 200 and the rear ice-skate adapter 100 are attached to the bottom of the sole 10. For reference, the ice-skate boot 55 is shown with labels on the ice-skate boot toe end 52, the ice-skate boot rear end 56, the ice-skate boot outer edge 310 and the inner edge 305.

FIG. 4C depicts an isometric line drawing of the left footed ice-skate boot assembly 50 tipped with the heel end 56 facing the viewer. As shown, the front ice-skate adapter 200 and the rear ice-skate adapter 100 a fixedly attached to the boot sole 10. As further shown, the front adjustable cup 32 is connected to the front ice-skate adapter 200 on one end and the ice-skate blade 20 on the other and the rear adjustable cup 30 is connected to the rear ice-skate adapter 100 on one end and the ice-skate blade 20 on the other. The front ice-skate adapter 200 and the rear ice-skate adapter 100 are attached to the bottom of the sole 10. Here, the ice-skate boot 55 references the ice-skate boot outer edge 310 and the inner edge 305.

With the present description in mind, below are some examples of certain embodiments illustratively complementing some of the methods and apparatus embodiments discussed above and presented in the figures to aid the reader. The elements called out below are provided by example to assist in the understanding of the present invention and should not be considered limiting. The reader will appreciate that the below elements and configurations can be interchangeable within the scope and spirit of the present invention.

In that light, certain embodiments contemplate an ice skate adapter 100 comprising a cup body 110 defined between a skate sole end 117 and a skate end 118, said skate sole end 117 extending toward said skate end 118 in a vertical direction 140. The ice skate adapter 100 also comprises a sole interface surface 102 defined at said skate sole end 117 and including at least a portion of said skate sole end 117, said sole interface surface 102 conforming to a skate sole 10. At least two of the appendages 104 extend outwardly from said cup body 110 in a horizontal direction 142. The at least two appendages 104 form part of said sole interface surface 102. The at least two appendages 104 are resistant to vertical bending forces 148 (see FIG. 2C) in said vertical direction 140. Each appendage 104 comprises an adapter-to-sole attachment member 122 that is located towards an appendage distal end 109, The skate sole end 117 is configured to attach to said skate boot sole 10 via said adapter-to-sole attachment members 122 and said skate end 118 configured to attach to a skate blade 20, albeit by way of a cup 30.

The ice skate adapter embodiment 100 further envisioning wherein said sole interface surface 102 is concave to match the rounded/convex shape of the boot sole 10.

The ice skate adapter embodiment 100 further imagining wherein said sole interface surface 102 is non-planar meaning it can conform to mate/connect with some other shape associated with the boot sole 10, be it near the front of the boot 52 or the rear of the boot 56.

The ice skate adapter embodiment 100 further pondering wherein each of said adapter-to-sole attachment members 122 comprises a bolt hole 106 that align with threaded holes in the boot sole 10 whereby a bolt can clamp the ice skate adapter embodiment 100 to the boot sole 10.

The ice skate adapter embodiment 100 further considering wherein said ice skate adapter 100 is unitary or otherwise composed of a single piece of material. Two separate elements joined together via glue, bolt/s, or some other joining means is not considered a unitary element. On the other hand, a composite fiber or laminate can be a unitary element.

The ice skate adapter embodiment 100 further envisioning wherein said appendages 104 each comprising a web 120 that increases the secondary moment of inertia of said appendage 104 corresponding to said web 120.

The ice skate adapter embodiment 100 can additionally include wherein said skate end 118 is configured to attach to said skate blade 20 via an adjustable ice-skate blade post 30/32.

The ice skate adapter embodiment 100/200 further comprising six appendages 104 when it is a rear ice-skate adapter 100 (see FIG. 2A) and eight appendages 104 when it is a front ice-skate adapter (see FIG. 2B).

The ice skate adapter embodiment 100 further being imagined with said sole interface surface 102 not being parallel with a cup interface surface 119, said cup interface surface 119 is at said skate sole end 117 (see FIG. 2C).

The ice skate adapter embodiment 100 further considering that said cup body 110 has a cup body diameter 158 of between 1 inch and 2.5 inches.

An optional embodiment of the present invention contemplates an adjustable ice-skate blade-to-boot connector 100 comprising a cup body 110 defined between sole interface surface 202 and a cup surface 119 wherein the sole interface surface 202 conforms to a portion of a skate boot sole 10. A plurality of appendages 104 are envisioned extending outwardly from said cup body 110 wherein said plurality of appendages 104 are part of said cup surface 119. A bolt receiving aperture 106 is located at a distal end 109 of each of said appendages 104. A bolt receiving aperture 150 extends through said cup surface 119 whereby said bolt receiving aperture 150 is configured to connect said connector 100 with an ice-skate blade post 30.

The adjustable ice-skate blade-to-boot connector 100 embodiment further contemplating said sole interface surface 102 being concave.

The adjustable ice-skate blade-to-boot connector 100 embodiment further imagining at least two of said bolt receiving apertures 150 being defined by a bolt aperture ring 107, each of said bolt aperture rings 107 (122) being located at said distal end 109 of a corresponding appendage 104 of said appendages 104, each of said bolt aperture rings 107 being wider than at least a portion of said corresponding appendage 104.

The adjustable ice-skate blade-to-boot connector 100 embodiment further pondering wherein each of said appendages 104 comprises a thickness 155 of between 0.2 inches and 0.5 inches thick. This can further include a cup body-to-appendage web 120 that is triangular-shaped and extends from said cup body 110 towards said distal end 109 but does not interfere with said bolt receiving aperture 106 so that a bolt can go through the aperture 106 and the bolt head can rest on a surface (ring) surrounding the bolt aperture/hole 106.

The adjustable ice-skate blade-to-boot connector 100 embodiment further considering at least two of said appendages 104 comprising a width 156 of between 0.2 inches and 0.75 inches wide.

The adjustable ice-skate blade-to-boot connector 100 embodiment can further be wherein said ice skate adapter 100 is composed from a unitary piece of material.

Yet still other embodiments contemplate an ice skate joiner 200 comprising a cup body 210 defined between a first end 217 and a second end 218 and a plurality of appendages 204 extending outwardly from said cup body 210. The plurality of appendages 204 collectively define a boot sole surface 202 that conforms to a portion of a skate boot sole 10. The boot sole surface 202 is at said first end 217. A bolt receiving aperture (bolt hole) 106 is located at a distal end 109 of each of said appendages 204. At least two of said appendages 204 comprise a ring 107 (which is equal to a partial ring) surrounding said bolt receiving aperture 106. The ring 107 is larger than an appendage width 156 of said corresponding appendage 204. In the case of the front ice skate joiner 100 the appendages 104 extending towards the leading edge 236 and the trailing edge 234 comprise rings 107 that are larger than the appendage widths 204, however the middle appendages 104 that extend from the sides 131 and 132 do not have a ringed end that is larger, and may not have a ringed distal end 107, whatsoever. said second end 218 defining a ice-skate blade post interface surface 219 that is matingly engaged with an ice-skate blade post 32 via a locking bolt.

The ice-skate joiner embodiment 200 further comprises at least one appendage-to-appendage web 238 that span between two adjacent appendages 204. At least one of the appendage-to-appendage webs 238 further defining said boot sole surface 202, as shown by the common surface 202 of FIG. 3A.

The above embodiments are not intended to be limiting to the scope of the invention whatsoever because many more embodiments are easily conceived within the teachings and scope of the instant specification. Moreover, the corresponding elements in the above example should not be considered limiting.

It is to be understood that even though numerous characteristics and advantages of various embodiments of the present invention have been set forth in the foregoing description, together with the details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended embodiments are expressed. For example, though the ice-skate adapter embodiments 100/200 generally are configured to connect with an adjustable cup 30/32, they can equally connect or join with ice-skate posts, stays or some other attachment point extending out from the ice-skating blade 20 without departing from the scope and spirit of the present invention. Certain other embodiments contemplate instead of two ice-skate adapters, a single ice-skate adapter can be used to accomplish the same goals within the spirit and scope of the present invention. It should further be appreciated that the number of appendages and shape of the appendages can be different as can the shape of the cup body 110/210 and the hollowed out regions 112/114/116/212/214 without departing from the scope and spirit of the present invention. It should be understood and appreciated that any element described in one embodiment can be equally used and/or substituted in place of a like element in other embodiments without departing from the scope and spirit of the present invention. Further, the terms "one" is synonymous with "a", which may be a first of a plurality.

It will be clear that the present invention is well adapted to attain the ends and advantages mentioned as well as those inherent therein. While presently preferred embodiments have been described for purposes of this disclosure, numerous changes may be made which readily suggest themselves to those skilled in the art and which are encompassed in the spirit of the invention disclosed and as defined in the appended claims.

What is claimed is:

1. An ice skate adapter comprising:

a cup body defined between a skate sole end and a skate end, said skate sole end extending toward said skate end in a vertical direction;

a sole interface surface defined at said skate sole end and including at least a portion of said skate sole end, said sole interface surface conforming to a skate sole;

at least two appendages extending outwardly from said cup body in a horizontal direction, said at least two appendages form part of said sole interface surface, said at least two appendages resistant to vertical bending forces in said vertical direction;

each appendage comprising an adapter-to-sole attachment member located towards an appendage distal end, said skate sole end configured to attach to said skate boot sole via said adapter-to-sole attachment members and said skate end configured to attach to a skate blade; and said sole interface surface is not parallel with a cup interface surface, said cup interface surface is at said skate sole end.

2. The ice skate adapter of claim 1 wherein said sole interface surface is concave.

3. The ice skate adapter of claim 1 wherein said sole interface surface is non-planar.

4. The ice skate adapter of claim 1 wherein each of said adapter-to-sole attachment members comprises a bolt hole.

5. The ice skate adapter of claim 1 wherein said ice skate adapter is unitary.

6. The ice skate adapter of claim 1 wherein said appendages each comprising a web that increases the secondary moment of inertia of said appendage corresponding to said web.

7. The ice-skate adapter of claim 1 wherein said skate end is configured to attach to said skate blade via an adjustable ice-skate blade post.

8. The ice-skate adapter of claim 1 comprising six appendages when it is a rear ice-skate adapter and wherein said ice-skate adapter comprises comprising eight appendages when it is a front ice-skate adapter.

9. The ice-skate adapter of claim 1 wherein said cup body has a cup body diameter of between 1 inch and 2.5 inches.

10. An adjustable ice-skate blade-to-boot connector comprising:

a cup body defined between sole interface surface and a cup surface, the sole interface surface conforming to a portion of a skate boot sole;

a plurality of appendages extending outwardly from said cup body, said plurality of appendages are part of said cup surface;

a bolt receiving aperture located at a distal end of each of said appendages; and a bolt receiving aperture extending through said cup surface, said bolt receiving aperture configured to connect said connector with an ice-skate blade post, said sole interface surface is concave.

11. The adjustable ice-skate blade-to-boot connector of claim 10 wherein at least two of said bolt receiving apertures are defined by a bolt aperture ring, each of said bolt aperture rings is located at said distal end of a corresponding appendage of said appendages, each of said bolt aperture rings is wider than at least a portion of said corresponding appendage.

12. The adjustable ice-skate blade-to-boot connector of claim 10 wherein each of said appendages comprises a thickness of between 0.2 inches and 0.5 inches thick.

13. The adjustable ice-skate blade-to-boot connector of claim 12 further comprising a cup body-to-appendage web that is triangular-shaped and extends from said cup body towards said distal end but does not interfere with said bolt receiving aperture.

14. The adjustable ice-skate blade-to-boot connector of claim 10 wherein at least two of said appendages comprises a width between 0.2 inches and 0.75 inches wide.

15. The adjustable ice-skate blade-to-boot connector of claim 10 wherein said adjustable ice-skate blade-to-boot connector is composed from a unitary piece of material.

16. An ice skate joiner comprising:

a cup body defined between a first end and a second end;

a plurality of appendages extending outwardly from said cup body, said plurality of appendages collectively define a boot sole surface that conforms to a portion of a skate boot sole, said boot sole surface is at said first end;

a bolt receiving aperture located at a distal end of each of said appendages, at least two of said appendages each comprising a ring surrounding said bolt receiving aperture, said ring larger than an appendage width of said corresponding appendage; and said second end defining a ice-skate blade post interface surface that is matingly engaged with an ice-skate blade post via a locking bolt.

17. The ice-skate joiner of claim 16 comprising at least one appendage-to-appendage web that span between two adjacent appendages.

18. The ice-skate joiner of claim 17 wherein at least one of said appendage-to-appendage webs further defines said boot sole surface.

* * * * *